United States Patent [19]

Guest

[11] 4,221,105

[45] Sep. 9, 1980

[54] METHOD AND APPARATUS FOR APPLYING CLOSURES TO CONTAINERS

[75] Inventor: John H. Guest, Sutton Coldfield, United Kingdom

[73] Assignee: Metal Closures Limited, United Kingdom

[21] Appl. No.: 42,408

[22] Filed: May 25, 1979

[30] Foreign Application Priority Data

May 31, 1978 [GB] United Kingdom ..... 25109/78

[51] Int. Cl.[3] ..... B65B 7/28; B67B 3/08

[52] U.S. Cl. ..... 53/488; 53/334; 113/1 D

[58] Field of Search ..... 53/488, 333, 334, 335, 53/336, 337, 338, 339, 340; 113/1 D, 1 E

[56] References Cited

U.S. PATENT DOCUMENTS

| | | | |
|---|---|---|---|
| 3,336,728 | 8/1967 | Monaco | 53/334 |
| 3,631,650 | 1/1972 | Leftault | 53/488 |

*Primary Examiner*—Travis S. McGehee

*Attorney, Agent, or Firm*—Bryan & Bollo

[57] ABSTRACT

In applying an unthreaded metal closure to the threaded neck of a bottle by the use of profiled thread rollers to shape the skirt of the closure shell into conformity with the bottle thread while the shell is pressed down on the mouth of the bottle, the part of the skirt in which the thread is formed is engaged during the thread-rolling operation by at least one plain roll angularly displaced with respect to the thread rollers.

7 Claims, 6 Drawing Figures

Figures 1, 2, 3, 4:
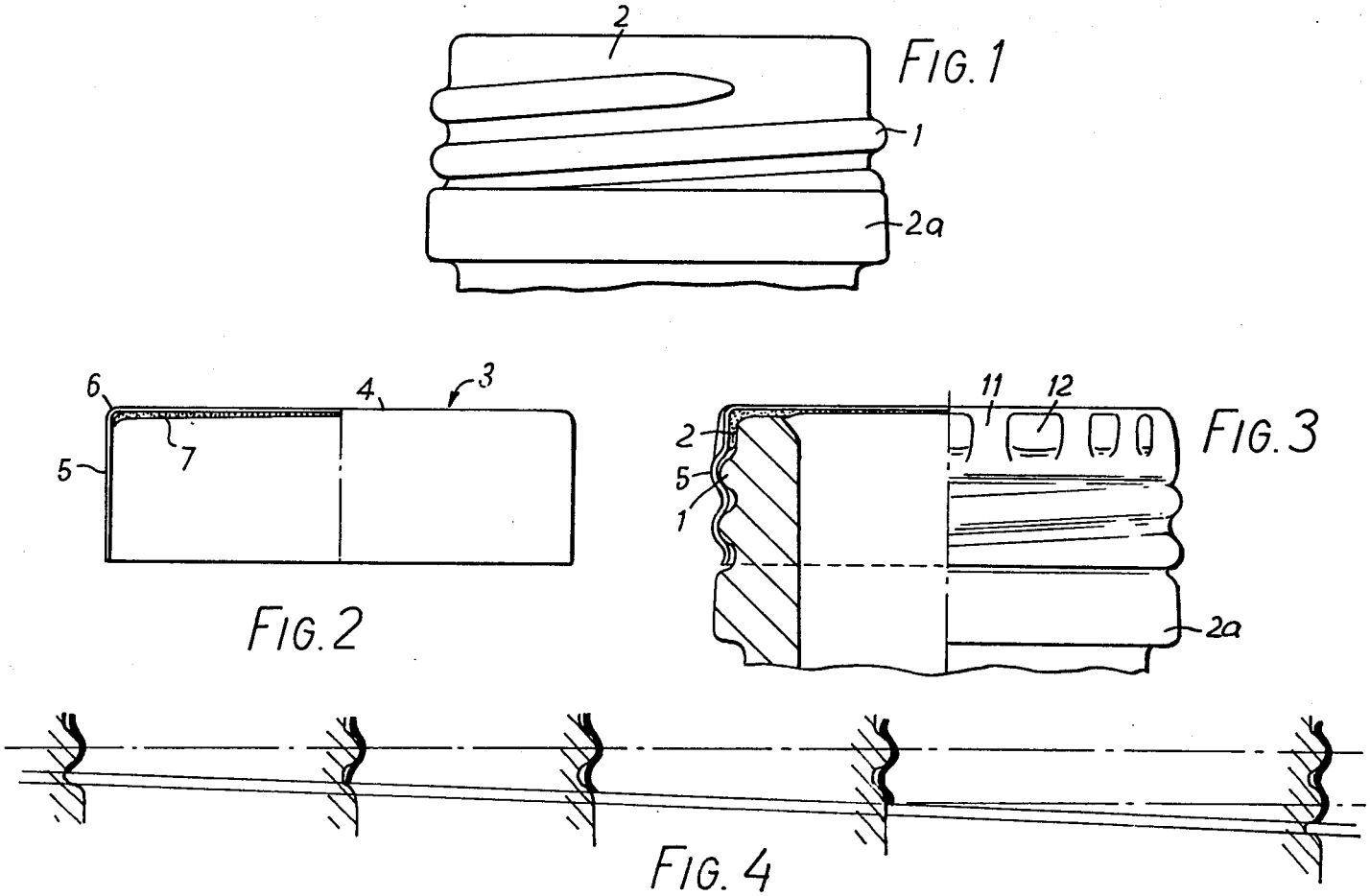

1
2a
2

2a
12
11
2
5
1

3
4
7
6
5

METHOD AND APPARATUS FOR APPLYING CLOSURES TO CONTAINERS

The present invention relates to closures for containers e.g. bottles and in particular it relates to a novel method and apparatus for applying reformable closures to bottles and like containers having an externally threaded neck, in such a manner as to form a pressure-holding seal between the cap and the container.

It has been known for many years to apply an unthreaded cup-shaped closure to an externally threaded bottle by placing the closure over the bottle mouth and rolling the unthreaded skirt of the closure into conformity with the thread of the bottle neck while at the same time applying pressure to the top of the closure to hold its gasket against the top end surface surrounding the bottle mouth.

Bottle closures of the present type are formed of ductile aluminium or aluminium alloy and in producing such closures it is desirable that the amount of material employed is kept to a minimum particularly for closures employed in packaging low cost products, such as carbonated beverages.

In closures of this type it is usual to provide an outwardly curled bead at the lower margin of the skirt to avoid the possibility of the user cutting fingers on a sharp metal edge and a band of knurling at or near the top of the skirt for manual grasping.

To achieve economy in metal usage it is possible to apply a closure, having no outwardly curled bead, to a bottle without much subsequent risk to the users fingers if, in the course of application, the bottom edge of the closure skirt is rolled into close conformity with the bottle. In conventional application of this class of closure the thread is formed by use of thread rollers which deform the metal lying between adjacent thread formations on the bottle. These thread rollers engage the closure skirt near the top and run out at the bottom of the thread groove. Where the rollers run out at the bottom of the skirt of a closure having no reinforcing bead at the bottom edge, the bottom margin of the skirt tends to flare outwardly.

It has already been proposed to meet this problem by providing a plain portion of lesser diameter on the underside of the thread roller, so that as the operating profiled portion of the thread roller follows the groove between two bottle threads, this plain portion follows the crest of the lower of the two threads and acts as a means for restraining outward flaring of the bottom margin of the closure in the region where the thread roller runs out of the groove. According to the present invention this problem is approached in a rather different way by employing a separate plain roller which presses against the full height of the portion of the skirt in which the thread is formed and is angularly displaced from the thread roller. The effect of this plain roller is to follow the profiled thread roller and to press the metal down against the crests of the thread formations on the bottle. In normal thread rolling operation the metal of the skirt tends to billow upwardly over the crests of the threads. Subsequent rolling by means of plain roller compacts this billowing and produces better conformity of the thread in the skirt wall with the thread formations on the bottle.

According to a further feature of the invention a tool set for the application of a closure to a container having an externally screw-threaded neck and a plain cylindrical sealing surface between the screw thread and the mouth of the bottle comprises a body for attachment to the head of a sealing machine, said body incorporating a fluted throat having an internal diameter less than that of the closure but greater than that of the cylindrical surface on the bottle neck, a resiliently loaded pressure member within said throat arranged for limited movement axially of said throat, two or more profiled thread rollers mounted on said body at equiangular positions around the axis of said throat, a plain roller located between each pair of adjacent thread rollers, means for moving said plain rollers and thread rollers into and out of engagement with the skirt of said closure and for moving said rollers about the axis of the bottle neck in the conventional manner.

The sealing head of a sealing machine is designed to move the tool set vertically to bring the throat member down over a closure member placed on the top of a bottle and thus provides the motion to effect the formation of a band of knurling in the top end of the skirt simultaneously with the formation of a side seal between the closure gasket and the bottle side sealing surface. The movement of the thread rollers and plain rollers into and out of engagement with the closure skirt is achieved in known manner, for example by the mechanism described in U.S. Pat. No. 1,369,793.

Figure 5:
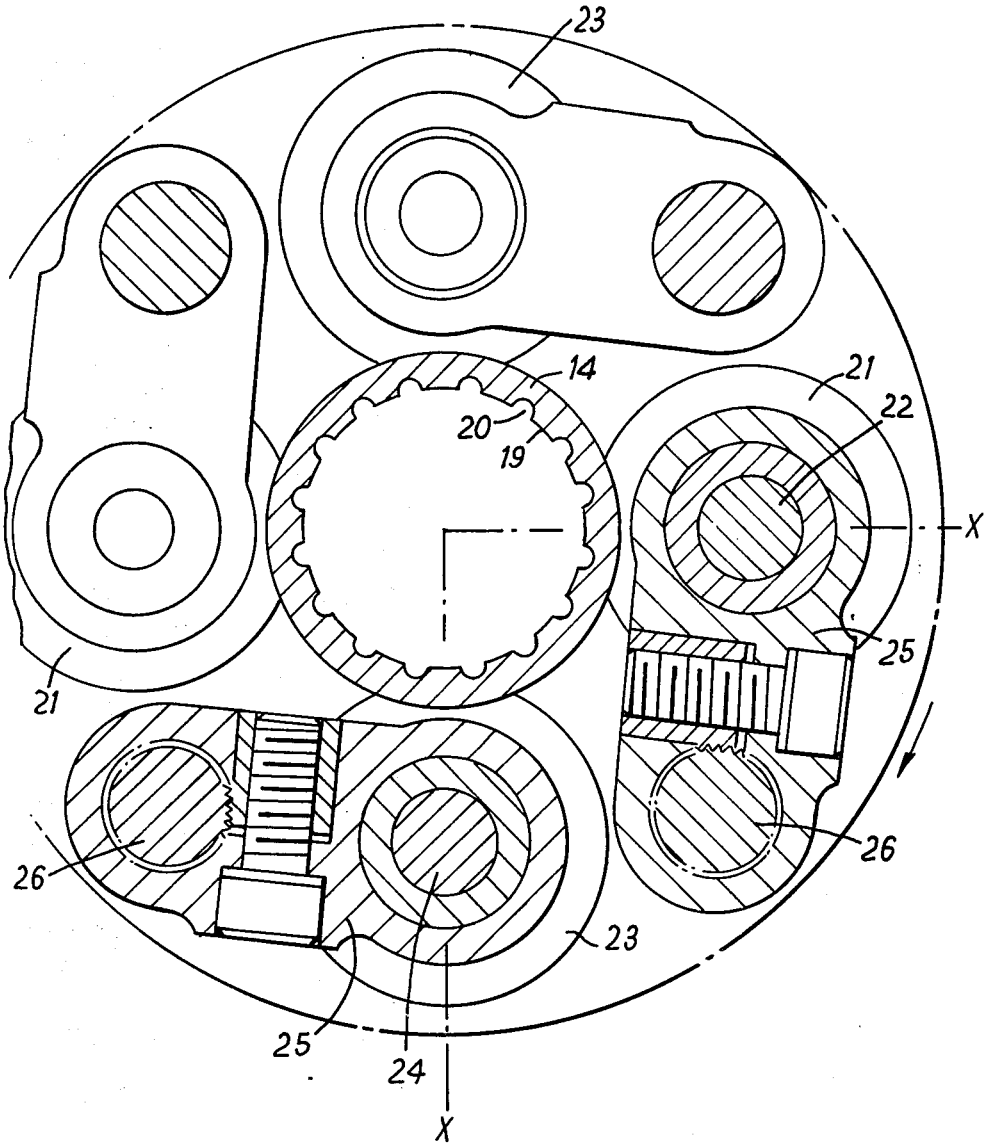
Figure 6:
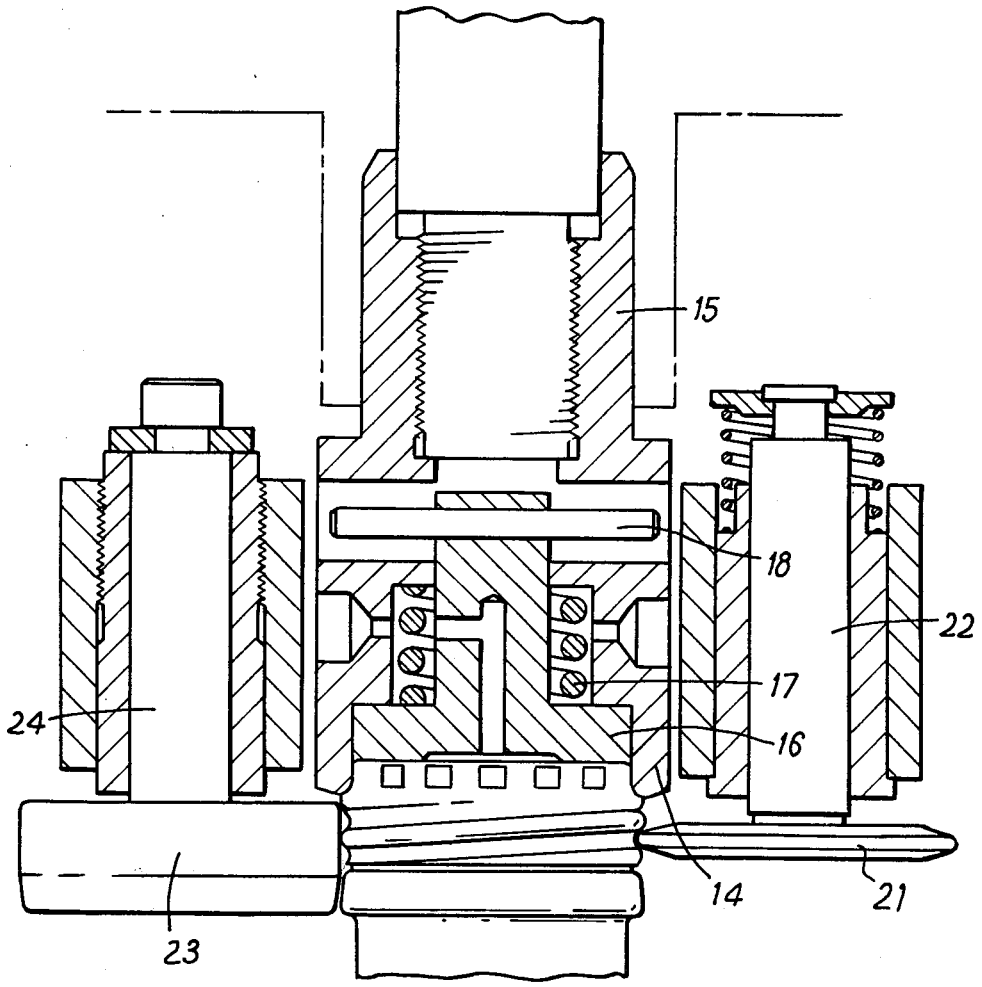

Referring now to the accompanying drawings:

FIG. 1 illustrates the neck of one standard bottle,

FIG. 2 is a part section of a closure for application to the standard bottle by the method of the invention, FIG. 3 is a part section of the bottle and closure of FIG. 2 after application, FIG. 4 is a development of the lower margin of the bottom edge of the closure in relation to the container thread, FIG. 5 is a semi-diagrammatic cross section of a tool set according to the invention, and FIG. 6 is a section on line X—X of FIG. 5.

The bottle neck shown in FIG. 1 has a screw thread formation 1 and a cylindrical sealing surface 2 above.

In the method of the invention the bottle is sealed by application of the very simple closure shown in FIG. 2. The closure is a cup-shaped pressing having a metal shell 3, comprising a top 4 and a cylindrical skirt 5 which meet at a radiused corner 6. The closure is completed by a body of gasket material 7, which is somewhat thickened at or near the radiused corner 6. Other known forms of gasket may be employed in place of the gasket 7.

In the course of application the closure is changed to the shape shown in FIG. 3, in which it can be seen that a band of knurling has been formed at 11 in the skirt 5 and at the bottom fo each knurl depression 12 the gasket material is compressed against the sealing surface 2.

As a result of application by means of the tool set illustrated in FIGS. 5 and 6, the bottom edge of the closure skirt tends to confirm closely to the bottle thread form, as is visible in both FIGS. 3 and 4.

Reference to FIGS. 5 and 6 shows the forming throat 14, which is integral with a body 15 for securing to the sealing head of a sealing machine of known construction. The throat 14 has a presser block 16 slidably mounted thereon and loaded by means of heavy spring 17. The outward movement of the presser block is limited by stop pin 18 in the conventional manner.

The construction of the forming throat is illustrated in FIG. 5 and it will be seen that, in section, it is comprised of a series of lands 19, which are separated by semi-circular recesses 20 of approximately equal angular extent as the lands 19 in relation to the axis of the throat. The downward movement of throat member 14 over the closure supported on a container produces a band of knurling as illustrated in FIG. 5, while the yielding presser block presses the closure firmly against the top of the container.

It will be seen from FIGS. 5 and 6 that the tool set includes a pair of diametrically opposed conventional profiled thread rollers 21, each mounted on a spring-loaded spindle 22 which allows downward movement of the roller in conventional manner as the roller follows the groove between adjacent turns of the bottle thread. At 90° to the thread rollers 21 there are a pair of diametrically opposed plain rollers 23 each mounted for rotation on a spindle 24. The spindles of the rollers 21 and 23 are respectively carried by lever arms 25 which are keyed to spindles 26 for limited arcuate movement to bring the rollers into engagement with the skirt at the commencement of the thread rolling operation and for disengagement from the bottle in the known way at the completion of the thread rolling operation.

It will be seen that in effect each profiled thread roller 21 is followed by a plain roller 23 which follows the crest of the thread formed by the thread roller 21. The action of the plain rollers 23, in addition to flattening out any outward curling of the metal of the skirt in the region where the thread rollers runs out at the bottom of the skirt, is to compress the thread corrugation onto the crest of the bottle thread and simultaneously to obtain better conformity between the bottle thread and the closure thread at the bottom of the thread groove above the crest of the bottle thread. The flattening effect of the plain rolls also has some "draw down" effect on the unthreaded metal below the profile thread rolls.

The plain rolls, in addition to controlling the bottom margin of the skirt, improve the engagement of the closure thread with the bottle thread. The internal pressure in the bottle, which the thread can withstand wihtout blow off, is thus increased as compared with that which can be withstood where the closure is applied by conventional thread rolling tools. Thus the overall extend of the thread may be somewhat decreased where theclosure is required to perform a specified pressure holding duty.

While the principal utility of the method and application tool of the present invention is in applying closures which have a bead-free skirt, the compaction of the closure thread onto the top of the bottle thread is also useful even where the closure is provided with a bead. In such case however the plain roller should be profiled in such a way that it does not apply a compacting force to the closure bead.

I claim:

1. A method of applying an unthreaded metal closure to a container having an externally threaded neck which method comprises placing the unthreaded closure over the mouth of the container, pressing the closure down against the mouth of the container and, whilst so held, forming thread in the closure skirt by means of two or more profiled thread rollers characterised in that during the thread rollng operation the portion of the closure skirt in which the thread is formed is engaged by at least open plain roll angularly displaced in relation to the thread rolls.

2. A method according to claim 1 in which said skirt is engaged by at least two plain rolls.

3. A method according to claim 1 in which the skirt of the unthreaded metal closure has a bead-free lower margin and the plain roll or rolls at the commencement of the thread rolling operation extend below said lower margin.

4. A method according to claim 1 in which the thread is formed by a pair fo diametrically opposed thread rollers and a pair of diametrically opposed plain rolls are located between said thread rollers.

5. A tool set for the application of a closure to a container having an externally screw-threaded neck and a plain cylindrical sealing surface between the screw thead and the mouth of the container comprising a body for attachment to the head of sealing machine, a throat having an internal diameter less than that of the upper end of the closure skirt, but greater than that of the cylindrical surface on the container neck, a resiliently loaded pressure member within said throat arranged for limited movement axially of said throat, two or more profiled thread rollers mounted on said body at equiangular positions around the axis of said throat, a plain roll located between each pair of adjacent thread rollers said plain roll having a cylindrical portion for engagement with said closure skirt, means for moving said plain rolls and thread rollers into and out of engagement with the skirt of said closure.

6. A tool set according to claim 5 further characterised in that the cylindrical surface of said plain rolls is arranged to extend axially beyond the bottom margin of the skirt of said closure.

7. A tool set according to claim 5 further characterised in that the internal surface of said throat is fluted.

* * * * *